US010285221B2

(12) United States Patent
Yasutake et al.

(10) Patent No.: US 10,285,221 B2
(45) Date of Patent: May 7, 2019

(54) INDUCTION HEATING COIL, INDUCTION HEATING DEVICE, AND HEATING METHOD

(71) Applicant: NETUREN CO., LTD., Shinagawa-ku, Tokyo (JP)

(72) Inventors: Hidehiro Yasutake, Tokyo (JP); Fumiaki Ikuta, Tokyo (JP); Kengo Fukazawa, Tokyo (JP)

(73) Assignee: NETUREN CO., LTD., Tokyo (JP)

( * ) Notice: Subject to any disclaimer, the term of this patent is extended or adjusted under 35 U.S.C. 154(b) by 316 days.

(21) Appl. No.: 15/022,721

(22) PCT Filed: Sep. 17, 2014

(86) PCT No.: PCT/JP2014/074536

§ 371 (c)(1),
(2) Date: Mar. 17, 2016

(87) PCT Pub. No.: WO2015/041240

PCT Pub. Date: Mar. 26, 2015

(65) Prior Publication Data

US 2016/0234885 A1 Aug. 11, 2016

(30) Foreign Application Priority Data

Sep. 17, 2013 (JP) ..... 2013-191778

(51) Int. Cl.
*H05B 6/04* (2006.01)
*H05B 6/10* (2006.01)
(Continued)

(52) U.S. Cl.
CPC ..... *H05B 6/04* (2013.01); *H05B 6/102* (2013.01); *H05B 6/36* (2013.01); *H05B 6/40* (2013.01); *H05B 6/44* (2013.01)

(58) Field of Classification Search
CPC ..... H05B 6/40; H05B 6/44; H05B 6/102; H05B 6/04; H05B 6/36
(Continued)

(56) References Cited

U.S. PATENT DOCUMENTS 2,620,433 A * 12/1952 Denneen ..... H05B 6/40 219/643
2,643,325 A * 6/1953 Body ..... C21D 9/28 148/572
(Continued)

FOREIGN PATENT DOCUMENTS

CN 2502386 7/2002
CN 1981699 6/2007
(Continued)

OTHER PUBLICATIONS

International Search Report dated Dec. 16, 2014 in application No. PCT/JP2014/074536 with English translation.
(Continued)

*Primary Examiner* — Thien S Tran
(74) *Attorney, Agent, or Firm* — Weneroth, Lind & Ponack, L.L.P.

(57) ABSTRACT

An induction heating coil (3) has a primary coil (4) to which electric power is supplied and a ring-shaped secondary coil (5) forming a closed circuit. The primary coil (4) has a base-side portion that covers an outer periphery of the secondary coil (5) and a distal-side portion extending from the base-side portion in the center axis direction of the secondary coil (5) in a state in which the base-side portion covers the secondary coil (5). The opening width of the base-side portion is greater than the opening width of the distal-side portion. The secondary coil (5) is provided such
(Continued)

that it can be inserted into and removed from the inside of the primary coil (4) from the base-side portion of the primary coil (4).

19 Claims, 9 Drawing Sheets

(51) Int. Cl.
*H05B 6/36* (2006.01)
*H05B 6/40* (2006.01)
*H05B 6/44* (2006.01)

(58) Field of Classification Search
USPC ..... 219/611, 613, 630, 635, 639, 642, 645
See application file for complete search history.

(56) References Cited

U.S. PATENT DOCUMENTS

| | | | |
|---|---|---|---|
| 2007/0103267 | A1 | 5/2007 | Okada |
| 2010/0147831 | A1 | 6/2010 | Minoue et al. |
| 2010/0163551 | A1 | 7/2010 | Minoue et al. |
| 2015/0102369 | A1 | 4/2015 | Hata et al. |
| 2016/0234885 | A1 | 8/2016 | Yasutake et al. |

FOREIGN PATENT DOCUMENTS

| | | | | |
|---|---|---|---|---|
| DE | 758 421 | | | 2/1953 |
| DE | 758421 | C | * | 2/1953 |
| JP | 52-21215 | | | 6/1977 |
| JP | 57-47555 | | | 10/1982 |
| JP | 59-023813 | | | 2/1984 |
| JP | 64-3924 | | | 1/1989 |
| JP | 5-33496 | | | 4/1993 |
| JP | 7-34598 | | | 6/1995 |
| JP | H09-31533 | | | 2/1997 |
| JP | 2000-087135 | | | 3/2000 |
| JP | 2010-018845 | | | 1/2010 |
| JP | 2010018845 | A | * | 1/2010 |
| JP | 2013-191778 | | | 9/2013 |
| JP | 6101608 | | | 3/2017 |

OTHER PUBLICATIONS

Extended European Search Report dated May 4, 2017 in corresponding European Application No. 14846633.7.

* cited by examiner

INDUCTION HEATING COIL, INDUCTION HEATING DEVICE, AND HEATING METHOD

TECHNICAL FIELD

The present invention relates to an induction heating coil, an induction heating device, and a heating method.

BACKGROUND ART

When performing a heat treatment on a stepped workpiece having a relatively thick portion and a relatively thin portion provided on one or both sides of the thick portion, the workpiece is typically heated in a furnace from the viewpoint of uniform heating, but induction heating methods have also been proposed (see, e.g., Patent document 1).

An induction heating coil disclosed in Patent document 1 is configured to inductively heat a double-side-stepped workpiece having a large-diameter shaft portion and small-diameter shaft portions provided on both axial sides of the large-diameter shaft portion. This induction heating coil is configured such that a conductor extends parallel with an outer line of a cross section, including its center axis, of a workpiece, and generates a magnetic flux when supplied with high-frequency power. The workpiece is inductively heated receiving the magnetic flux generated by the induction heating coil while being rotated about its center axis.

PRIOR ART DOCUMENT

Patent Document

Patent Document 1: JPH5-33496U

SUMMARY OF INVENTION

Problems to be Solved by Invention

In induction heating, the heating efficiency lowers as the gap between an induction heating coil and a workpiece increases. In contrast, in the induction heating coil disclosed in Patent Document 1, since it is formed by the conductor extending parallel with the outer line of the cross section, including the center axis, of the workpiece, the gap between itself and the workpiece can be made small and the workpiece can be set in and removed easily.

However, in the induction heating coil disclosed in Patent Document 1, a magnetic field that is formed around itself cannot be adjusted locally and hence it is difficult to adjust the temperatures of individual portions of the workpiece heated so as to obtain a uniform or desired temperature.

The present invention has been made in view of the above circumstances, and it is an object thereof to provide an induction heating coil, an induction heating device, and a heating method that can be suitably used for heat treatment of a double-side-stepped workpiece having a relatively thick portion and relatively thin portions provided on both sides thereof.

Means for Solving the Problems

According to an aspect of the present invention, an induction heating coil includes a primary coil to which electric power is supplied, and a ring-shaped secondary coil forming a closed circuit. The primary coil includes a base-side portion that covers an outer periphery of the secondary coil and a distal-side portion extending from the base-side portion in a center axis direction of the secondary coil in a state in which the base-side portion covers the secondary coil, and an opening width of the base-side portion is greater than an opening width of the distal-side portion. The secondary coil is provided such that the secondary coil is removable inserted into the primary coil from the base-side portion of the primary coil.

According to another aspect of the present invention, an induction heating device includes the induction heating coil described above, a power source unit configured to supply the electric power to the primary coil of the induction heating coil, a workpiece supporting portion configured to support a workpiece and to move the workpiece relative to the primary coil to insert the workpiece into the primary coil from the base-side portion of the primary coil, and a secondary coil supporting portion configured to support the secondary coil of the induction heating coil and to move the secondary coil relative to the primary coil to insert the secondary coil into the primary coil from the base-side portion of the primary coil.

According to another aspect of the present invention, a heating method is provided to heat a workpiece having a relatively thick portion and relatively thin portions provided on both sides of the thick portion using the induction heating coil described above. The heating method includes inserting the workpiece into the primary coil of the induction heating coil from the base-side portion of the primary coil such that one of the thin portions of the workpiece is accommodated in the distal-side portion of the primary coil and such that the thick portion and the other thin portion of the workpiece are accommodated in the base-side portion of the primary coil, inserting the secondary coil of the induction heating coil into the primary coil from the base-side portion of the primary coil such that the secondary coil is arranged between the base-side portion of the primary coil and the thin portion of the workpiece that is accommodated in the base-side portion, and supplying the electric power to the primary coil to inductively heat the workpiece.

Advantages of Invention

According to the invention, in induction heating a double-side-stepped workpiece, the gap between the induction heating coil and the workpiece can be made small over the entire workpiece because one thin portion of the workpiece is accommodated in the distal-side portion of the primary coil that has a relatively small opening width, the thick portion and the other thin portion of the workpiece are accommodated in the base-side portion of the primary coil that has a relatively large opening width, and the secondary coil is arranged between the base-side portion of the primary coil and the thin portion of the workpiece that is accommodated in the base-side portion. As a result, the workpiece can be heated uniformly and efficiently in its entirety.

In the invention, a double-side-stepped workpiece can be set in and removed from the induction heating coil by inserting or removing the workpiece and the secondary coil from the base-side portion of the primary coil that has a relatively large opening width. Therefore, the double-side-stepped workpiece can be set in and removed from the induction heating coil easily though the device configuration is simple.

In the invention, the secondary coil that forms a closed circuit can be replaced relatively easily. Therefore, the magnetic field that is formed around the secondary coil can be adjusted locally by replacing the secondary coil. As a result, the heating temperature of the thin portion of the workpiece that is accommodated in the secondary coil can be adjusted relatively easily

EMBODIMENTS OF INVENTION

Figure 1:
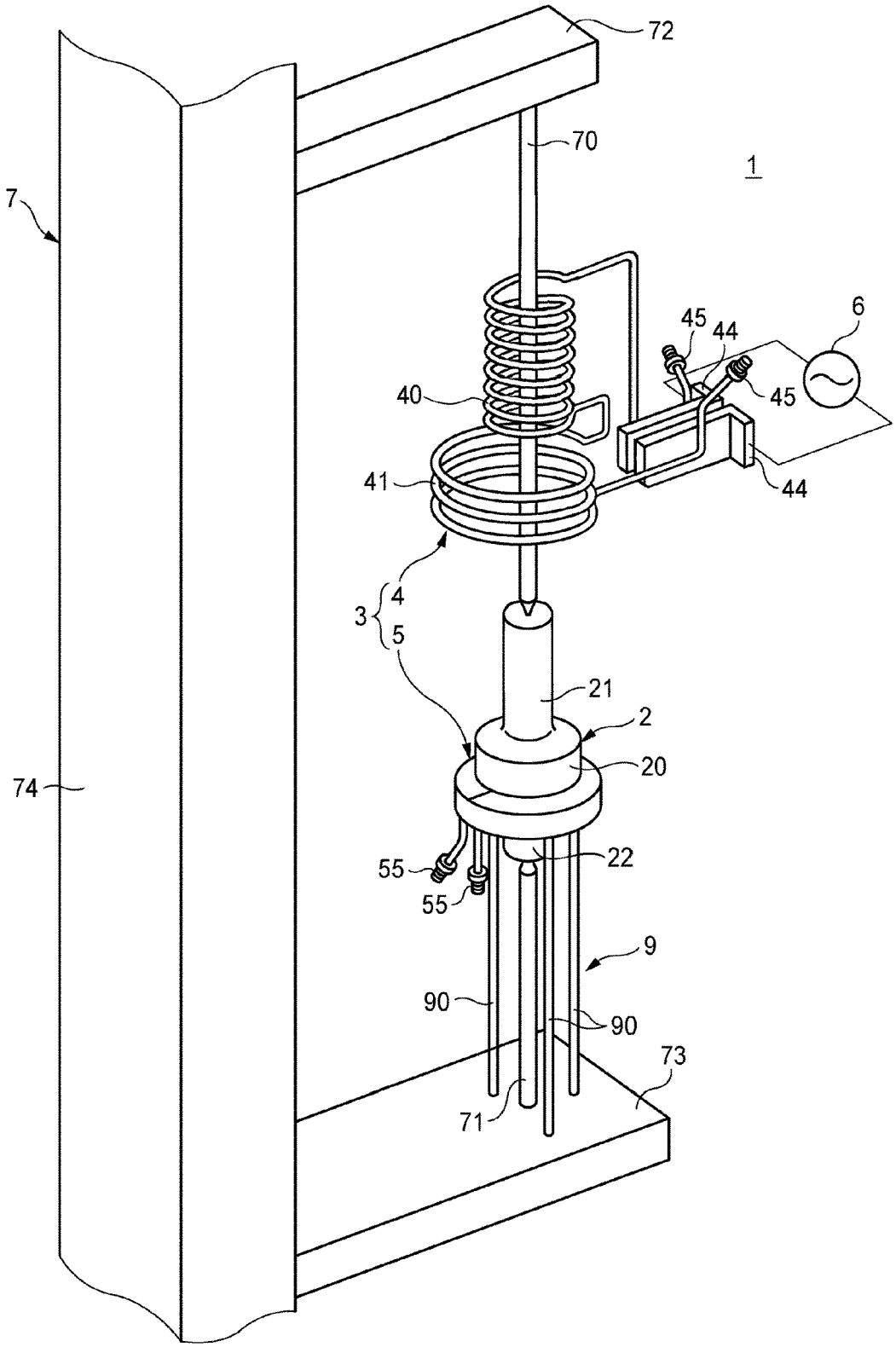
FIG. 1 is a view illustrating an exemplary structure of an induction heating coil and an induction heating device, for describing an embodiment of the present invention.

FIG. 1 shows the configurations of an example induction heating coil and induction heating device for description of an embodiment of the present invention.

A heating device 1 is configured to inductively heat a workpiece 2, and includes an induction heating coil 3 having a primary coil 4 and a secondary coil 5, a power source unit 6 for supplying AC power to the primary coil 4, a workpiece supporting portion 7, and a secondary coil supporting portion 9.

The workpiece 2 is a double-side-stepped workpiece having a relatively thick portion and relatively thin portions provided on both sides of the thick portion. In the illustrated example, the workpiece 2 is substantially cylindrical as a whole, and has a large-diameter shaft portion 20 and small-diameter shaft portions 21, 22 provided on both axial sides of the large-diameter shaft portion 20. The small-diameter shaft portion 21 is longer than the other small-diameter shaft portion 22. The workpiece 2 is not limited to the one shown in the drawing, and may be, for example, a substantially prism-shaped workpiece.

The workpiece supporting portion 7 includes a first rod 70 and a second rod 71 which hold the workpiece 2 between them in their axial direction by pushing end surfaces of the two respective small-diameter shaft portions 21, 22, a first rod supporting portion 72 and a second rod supporting portion 73 which support the pair of rods 70, 71, respectively, and a drive unit 74 for moving the pair of rod supporting portions 72, 73 forward and backward in the axial direction. The drive unit 74 is an appropriate rectilinear mechanism using a ball screw, a cylinder/piston, or the like. The workpiece supporting portion 7 may be provided with a rotation mechanism for rotating, if necessary, the pair of rods 70, 71 about the axis in induction heating the workpiece 2 so that the pair of rods 70, 71 are rotated to rotate the workpiece 2 held between them.

The primary coil 4 is has a substantially cylindrical shape as a whole, and is configured to accommodate the workpiece 2. The primary coil 4 is configured such that its opening width is greater on the distal end side than the base end side. In the illustrated example, the primary coil 4 is substantially cylindrical as a whole, and is divided into a first heating portion 40 and a second heating portion 41 (arranged in this order from the tip side) so as to conform to the outer circumferential surfaces of the longer, small-diameter shaft portion 21 and the large-diameter shaft portion 20 of the workpiece 2, whereby its inner diameter (opening width) increases stepwise in the above arrangement direction. The first heating portion 40 is configured to accommodate the longer, small-diameter shaft portion 21 of the workpiece 2, and the second heating portion 41 is configured to accommodate the large-diameter shaft portion 20 and the shorter, small-diameter shaft portion 22. The primary coil 4 need not always be substantially cylindrical. For example, in a case in which the workpiece 2 has a prism shape, the primary coil 4 may be provided in a substantially polygonal-tube-shaped so as to conform to the outer shape of the workpiece 2.

The primary coil 4 is a solenoid coil, and is formed integrally by winding a single, conductive tubular material at winding diameters and intervals that are suitable for the first heating portion 40 and the second heating portion 41, respectively. Two end portions of the primary coil 4 are fastened to respective terminals 44 which are connected to the power source unit 6. A coolant such as water circulates through the tubular material of the primary coil 4, and the two end portions, fastened to respective terminals 44, of the primary coil 4 are provided with respective connectors 45 which are connected to a coolant supply unit (not shown).

The terminals 44 are fixed to, for example, a device stage (not shown) and their positions are thereby fixed. The primary coil 4 is supported by the terminals 44 and is thereby set coaxial with the first rod 70 and the second rod 71 of the workpiece supporting portion 7 and the workpiece 2 which is held between the pair of rods 70, 71.

As described later in detail, the secondary coil 5 is configured to accommodate the shorter, small-diameter shaft portion 22 of the workpiece 2 and to be inserted into and removed from the second heating portion 41 of the primary coil 4. In the illustrated example, as in the case of the primary coil 4, the secondary coil 5 is formed by a conductive tubular material, a coolant such as water circulates through the tubular material of the secondary coil 5, and the secondary coil 5 is provided with connectors 55 which are connected to the coolant supply unit (not shown).

The secondary coil supporting portion 9 has plural shafts 90 which are erected from the second rod supporting portion 73 substantially parallel with the second rod 71 of the workpiece supporting portion 7.

The secondary coil 5 is supported by the plural shafts 90 so as to be coaxial with the first rod 70 and the second rod 71 of the workpiece supporting portion 7 and the workpiece 2 which is held between the pair of rods 70, 71. By suitably adjusting the lengths of the plural shafts 90, the secondary coil 5 is placed at such a position as to accommodate the shorter, small-diameter shaft portion 22 of the workpiece 2 held between the pair of rods 70, 71. Even in the case where the workpiece supporting portion 7 is provided with a rotation mechanism for rotating the pair of rods 70, 71 about the axis and the pair of rods 70, 71 are rotated by this mechanism, the secondary coil 5 is not rotated but fixed to the second rod supporting portion 73 via the plural shafts 90.

Figure 2:
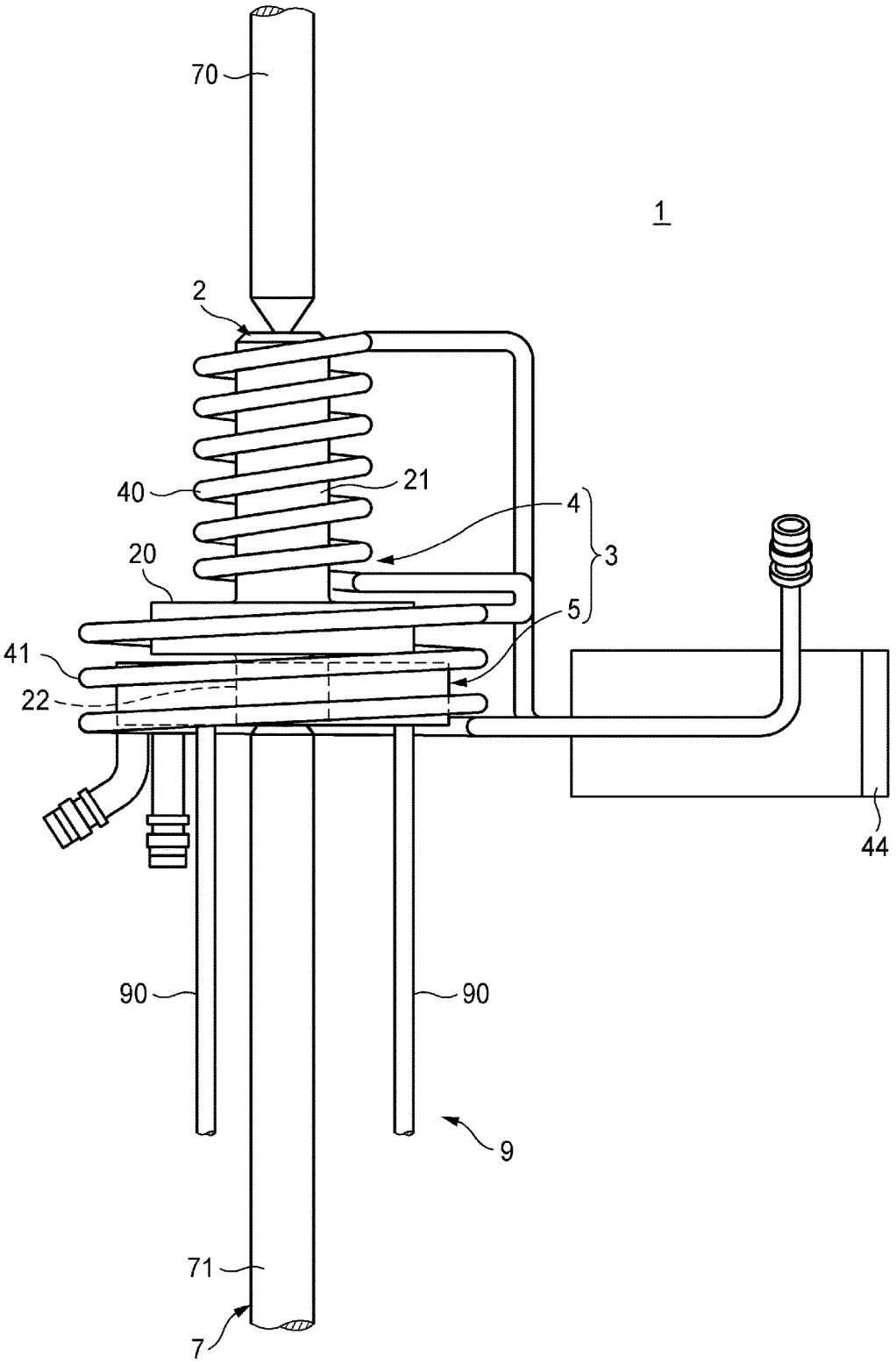
FIG. 2 is a view illustrating the induction heating device shown in FIG. 1 in a state in which it is performing a heating operation.

FIG. 2 shows a state that the heating device 1 is performing a heating operation.

As the first rod 70 and the second rod 71 of the workpiece supporting portion 7 are moved by the drive unit 74, the workpiece 2 held between the pair of rods 70, 71 is inserted into the primary coil 4 from the side of the second heating portion 41 of the primary coil 4 with its longer, small-diameter shaft portion 21 directed to the destination. The longer, small-diameter shaft portion 21 of the workpiece 2 is accommodated in the first heating portion 40, and the large-diameter shaft portion 20 and the shorter, small-diameter shaft portion 22 is accommodated in the second heating portion 41 of the primary coil 4.

As the first rod 70 and the second rod 71 of the workpiece supporting portion 7 are moved, the secondary coil 5 which is fixed to the second rod supporting portion 73 via the secondary coil supporting portion 9 is also inserted into the primary coil 4 and comes to be placed between the second heating portion 41 of the primary coil 4 and the shorter, small-diameter shaft portion 22 of the workpiece 2.

Figure 3:
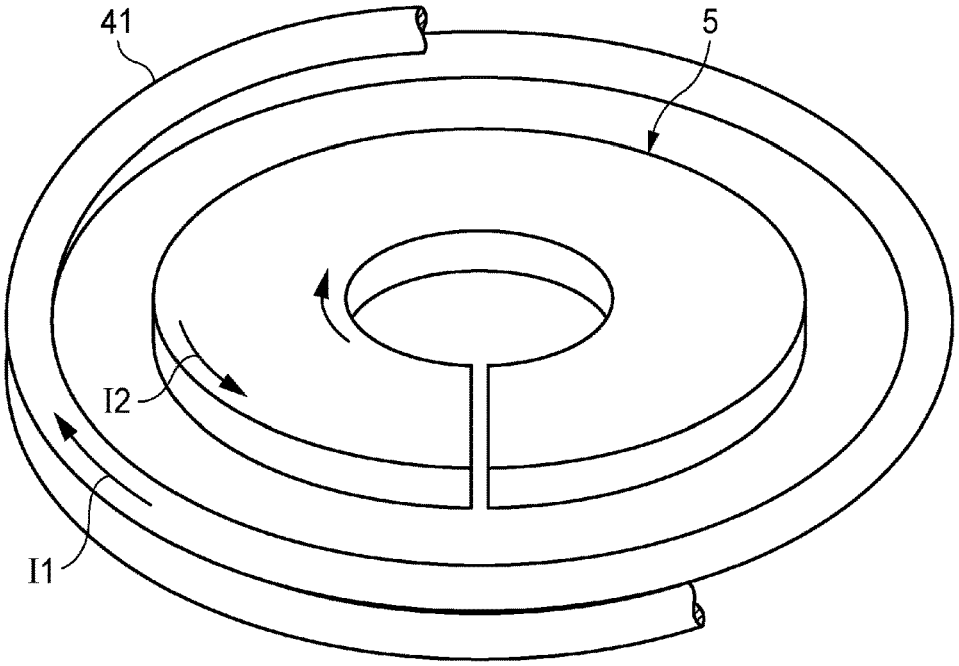
FIG. 3 is a view illustrating a structure of an example of a secondary coil of the induction heating coil shown in FIG. 1.

FIG. 3 shows the structure of the secondary coil 5.

The secondary coil 5 has a ring-like shape that is divided at one position in the circumferential direction, and forms a closed circuit circulating alongside the outer circumference and the inner circumference. In the illustrated example, the secondary coil 5 is formed in a substantially circular ring shape so as to extend parallel with the outer circumferential surface of the shorter, small-diameter shaft portion 22 and the inner circumferences of the second heating portion 41 of the primary coil 4. The secondary coil 5 need not always have a substantially circular ring shape. For example, in a case in which the workpiece 2 has a prisms shape, the secondary coil 5 may be provided in a rectangular ring shape so as to conform to the outer shape of the workpiece 2.

When AC power (current I1) is supplied to the primary coil 4 from the power source unit 6 in a state in which the secondary coil 5 is accommodated in the second heating portion 41 of the primary coil 4, the secondary coil 5 receives a magnetic flux generated by the second heating portion 41 of the power-supplied primary coil 4, as a result of which an electromotive force develops in the secondary coil 5 and an induction current I2 flows through the secondary coil 5 so as to circulate through its outer circumferential portion and inner circumferential portion because of the skin effect. In the inner circumferential portion, the induction current I2 flows in the same circumferential direction as the current I1 flowing through the second heating portion 41. Therefore, inside the secondary coil 5, the magnetic flux generated by the second heating portion 41 of the power-supplied primary coil 4 is added to a magnetic flux generated by the secondary coil 5. This increases the efficiency of heating of the shorter, small-diameter shaft portion 22 of the workpiece 2 that is accommodated in the secondary coil 5.

Figure 4:
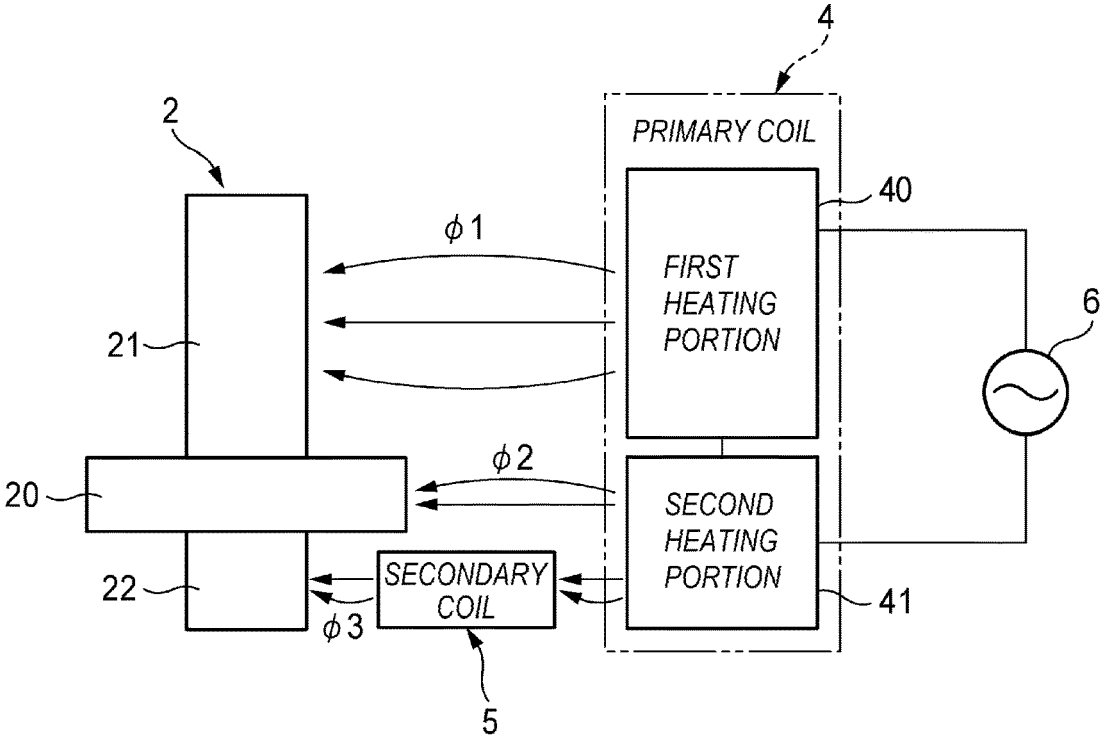
FIG. 4 is a diagram illustrating a induction heating system by the induction heating device shown in FIG. 1.

FIG. 4 schematically shows the mechanism of the induction heating of the workpiece 2 by the heating device 1.

When AC power is supplied to the primary coil 4 from the power supply unit 6, the first heating portion 40 and the second heating portion 41 of the power-supplied primary coil 4 generate fluxes $\phi 1$ and $\phi 2$, respectively.

The longer, small-diameter shaft portion 21 of the workpiece 2 that is accommodated in the first heating portion 40 of the primary coil 4 is inductively heated by receiving the magnetic flux $\phi 1$ generated by the first heating portion 40.

The large-diameter shaft portion 20 of the workpiece 2 that is accommodated in the second heating portion 41 is inductively heated by receiving the magnetic flux $\phi 2$ generated by the second heating portion 41.

The secondary coil 5 accommodated in the second heating portion 41 of the primary coil 4 receives the magnetic flux $\phi 2$ generated by the second heating portion 41 and an electromotive force develops in the secondary coil 5, whereby an induction current flows through the secondary coil 5. The secondary coil 5 generates a magnetic flux $\phi 3$ because of this induction current.

The shorter, small-diameter shaft portion 22 of the workpiece 2 that is accommodated in the secondary coil 5 is inductively heated receiving, mainly, the magnetic flux $\phi 3$ generated by the secondary coil 5.

After completion of the heating treatment on the workpiece 2, the first rod 70 and the second rod 71 of the workpiece supporting portion 7 are moved by the driving unit 74 and the workpiece 2 which is held between the pair of rods 70, 71 and the secondary coil 5 which is fixed to the second rod supporting portion 73 via the secondary coil supporting portion 9 are removed from the side of the second heating portion 41 of the primary coil 4.

The heating device 1 is to heat the workpiece 2 by induction heating in the above-described manner and, in general, requires a smaller installation space than heating furnaces. This makes it possible to incorporate the heating device 1 in a processing line of the workpiece 2 and perform heat treatment on the workpiece 2 in the processing line. Furthermore, plural heating devices 1 can be installed in a processing line of the workpiece 2. Still further, orientation of installation of the heating device 1 can be selected as appropriate according to a processing line of the workpiece 2 from vertical orientation in which the pair of rods 70, 71 of the workpiece supporting portion 7 extend vertically, horizontal orientation in which the pair of rods 70, 71 of the workpiece supporting portion 7 extend horizontally, and other kinds of orientation. In this manner, the heat treatment efficiency of the workpiece 2 can be made higher than in batch processes using a heating furnace.

According to the heating device 1, the gap between the workpiece 2 and the induction heating coil 3 can be made small over the entire heating device 1 because the longer, small-diameter shaft portion 21 of the workpiece 2 is accommodated in the first heating portion of the primary coil 4 that has a relatively small opening width, the large-diameter shaft portion 20 and the shorter, small-diameter shaft portion 22 of the workpiece 2 are accommodated in the second heating portion 41 of the primary coil 4 that has a relatively large opening width, and the secondary coil 5 is placed between the shorter, small-diameter shaft portion 22 and the second heating portion 41 of the primary coil 4. As a result, the workpiece 2 can be heated uniformly and efficiently in its entirety.

In the heating device 1, the workpiece 2 can be set in and removed from the induction heating coil 3 by inserting or removing the workpiece 2 and the secondary coil 5 from the side of the second heating portion 41 of the primary coil 4 that has a relatively large opening width. Therefore, the workpiece 2 can be set in and removed from the induction heating coil 3 easily though the device configuration is simple.

Further, according to the heating device 1, the workpiece 2 and the secondary coil 5 forming a closed circuit are moved, and the position of the primary coil 4 to which electric power is supplied can be fixed, whereby the power supply path can be maintained easily and the device configuration can be made even simpler. The entire workpiece 2 can also be heated uniformly by a configuration in which two coils are provided so as to accommodate the two respective parts, extending in the axial direction and bounded at the large-diameter shaft portion 20, of the workpiece 2 and are supplied with power independently. However, this configuration requires two power source units and at least one of the coils needs to be moved together with the associated power source unit. In contrast, the heating device 1 requires the only one power source unit and the positions of the power source unit and the primary coil 4 can be fixed, which is advantageous in terms of the equipment cost.

In the heating device 1, the secondary coil 5 that forms a closed circuit can be replaced relatively easily. Therefore, the magnetic field that is formed around the secondary coil 5 can be adjusted by replacing the secondary coil 5. As a result, the heating temperature of the shorter, small-diameter shaft portion 22 of the workpiece 2 that is accommodated in the secondary coil 5 can be adjusted relatively easily and the temperature distribution of the entire workpiece 2, for example, can be increased in uniformity.

Still further, in the heating device 1, the primary coil 4 is a solenoid coil. Therefore, the magnetic field that is formed around the first heating portion 40 can be adjusted by adjusting the wiring interval of the first heating portion 40 of the primary coil 4. As a result, the heating temperature of the longer, small-diameter shaft portion 21 of the workpiece 2 that is accommodated in the first heating portion 40 can be adjusted relatively easily and the heating temperature of the entire workpiece 2, for example, can be increased in uniformity.

Figure 5:
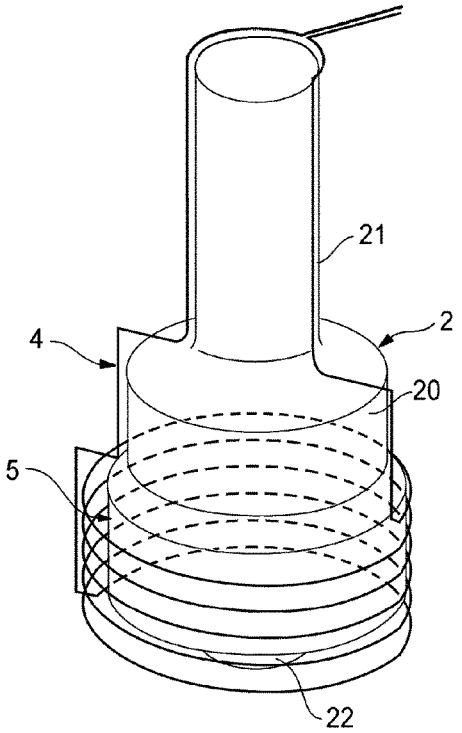
FIG. 5 is a view illustrating a structure of a modification of a primary coil of the induction heating coil shown in FIG. 1.

While the primary coil 4 has been described as having a substantially cylindrical shape as a whole in the heating device 1 described above, the primary coil merely needs to have a base-side portion that covers the outer periphery of the secondary coil 5 and a distal-side portion extending the base-side portion in the center axis direction of the secondary coil 5 in a state in which the base-side portion covers the secondary coil, and to make the opening width of the base-side portion greater than the opening width of the distal-side portion so that the secondary coil 5 can be inserted into and removed from the primary coil from the base-side portion. For example, as shown in FIG. 5, the primary coil 4 may be configured such that only the base-side portion that covers the outer periphery of the secondary coil 5 has a substantially cylindrical shape and the distal-side portion is a hairpin coil formed by arranging a conductor to extend substantially parallel with the outer line of a cross section including the center axis of the workpiece 2.

Figure 6:
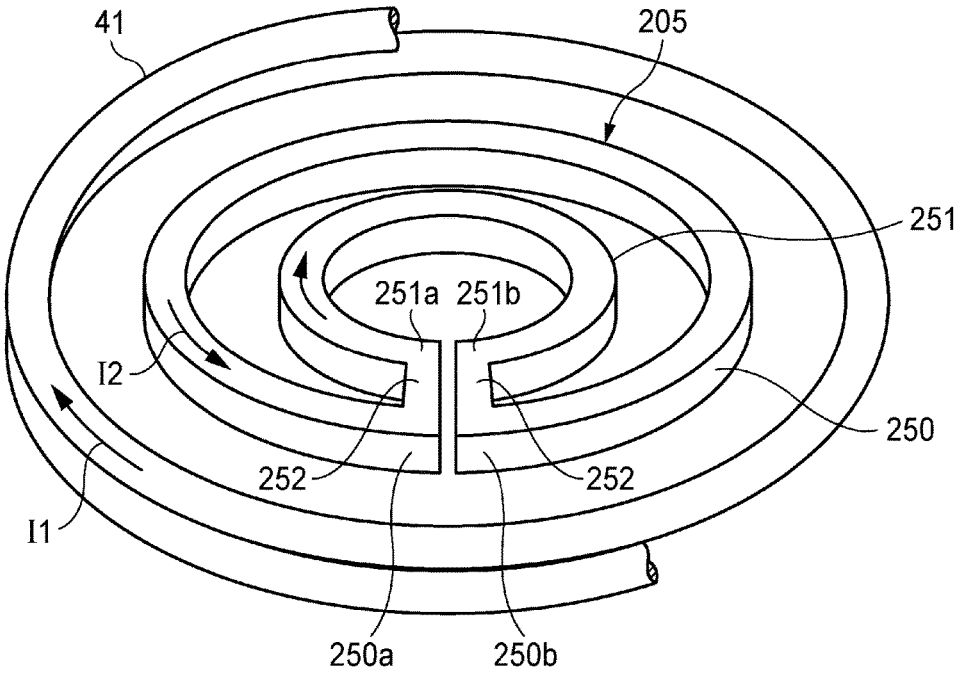
FIG. 6 is a view illustrating a structure of another example of the secondary coil of the induction heating coil shown in FIG. 1.
Figure 7:
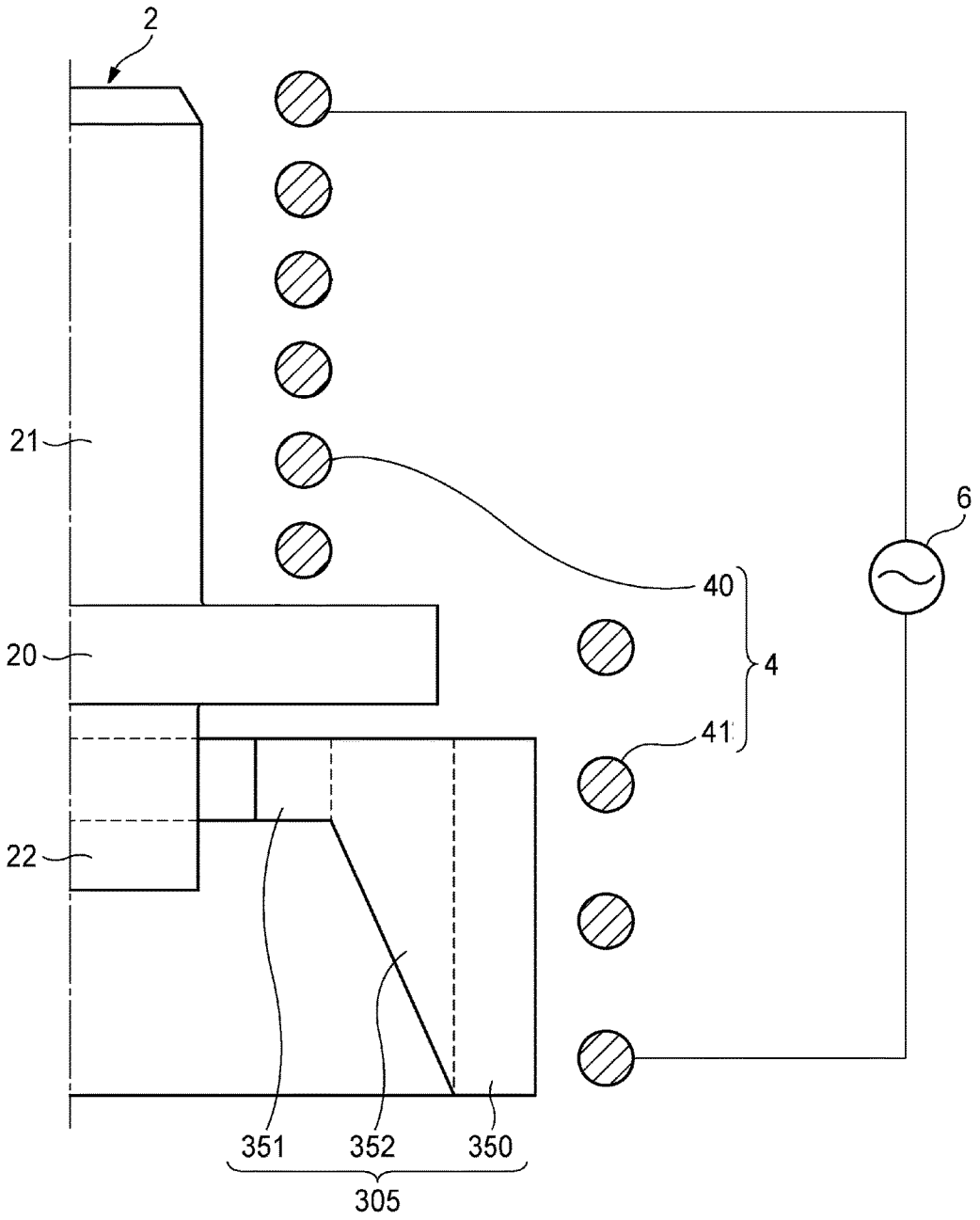
FIG. 7 is a view illustrating a structure of a further example of secondary coil of the induction heating coil shown in FIG. 1.

FIGS. 6 and 7 show structures of other examples of the secondary coil.

The second coil 205 shown in FIG. 6 has an outer conductor portion 250, an inner conductor portion 251, and a pair of connection conductor portions 252. Each of the outer conductor portion 250 and the inner conductor portion 251 has a ring shape that is divided at one position in the circumferential direction, and the inner conductor portion 251 is disposed inside the outer conductor portion 250 with a space formed between them. The pair of connection conductor portions 252 extend parallel with each other, and each connection conductor portion 252 connects an associated pair of ends (250*a* and 251*a*, and 250*b* and 251*b*), located on the same side of the dividing positions, of the outer conductor portion 250 and the inner conductor portion 251. As a result, the outer conductor portion 250 and the inner conductor portion 251 are connected to each other in series to form a closed circuit circulating the outer conductor portion 250 and the inner conductor portion 251.

When the primary coil 4 is supplied with power, an electromotive force develops in the secondary coil 5 and an induction current I2 flows through the secondary coil 5 so as to circulate through its outer conductor portion 250 and inner conductor portion 251. In the inner conductor portion 251, the induction current I2 flows in the same circumferential direction as a current I1 flowing through the second heating portion 41. Therefore, inside the secondary coil 205, a magnetic flux generated by the second heating portion 41 of the primary coil 4 is added to a magnetic flux generated by the secondary coil 205. As a result, like the secondary coil 5 shown in FIG. 3, the secondary coil 205 can increase the strength of the magnetic field formed inside itself. This increases the efficiency of heating of the shorter, small-diameter shaft portion 22 of the workpiece 2 that is accommodated in the secondary coil 5.

Like the secondary coil 205 shown in FIG. 6, a secondary coil 305 shown in FIG. 7 has an outer conductor portion 350 and an inner conductor portion 351, each having a ring shape that is divided at one position in the circumferential direction, and a pair of connection conductor portions 352 connecting the outer conductor portion 350 and the inner conductor portion 351 to each other in series, forming a closed circuit circulating the outer conductor portion 350 and the inner conductor portion 351. However, while the outer conductor portion 250 and the inner conductor portion 251 have the same axial dimension in the secondary coil 205 shown in FIG. 6, the axial dimension of the outer conductor portion 350 is longer than the axial dimension of the inner conductor portion 351 in the secondary coil 305 shown in FIG. 7.

The second heating portion 41, in which the secondary coil 305 is to be inserted, of the primary coil 4 corresponds to the outer conductor portion 350, elongated in the axial direction, of the secondary coil 305 and is elongated in the axial direction by increasing the number of turns so as to be able to accommodate the outer conductor portion 350.

As the number of turns of the second heating portion 41 of the primary coil 4 is made larger, the magnetic flux generated by the second heating portion 41 is increased. The amount of induction current flowing through the inner conductor portion 351 of the secondary coil 305 can be increased by receiving the increased magnetic flux fully by the outer conductor portion 350 of the secondary coil 305. As a result, the heating efficiency of the shorter, small-diameter shaft portion 22 of the workpiece 2 that is accommodated in the secondary coil 305 can be made even higher.

Figure 8:
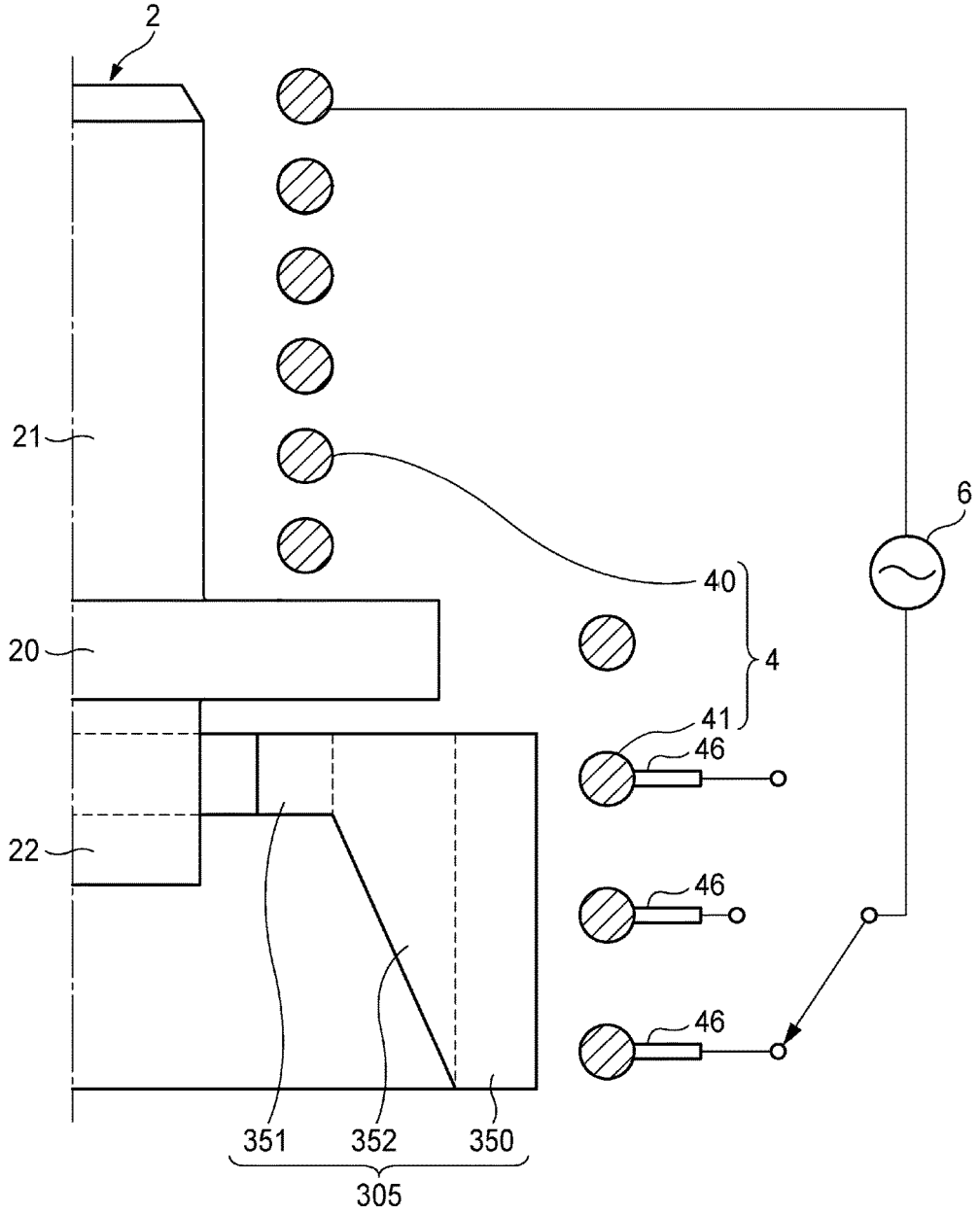
FIG. 8 is a view illustrating a structure of another example of the induction heating coil shown in FIG. 1.

Since in this manner the amount of induction current flowing through the inner conductor portion 351 of the secondary coil 305 can be adjusted by adjusting the number of turns of the second heating portion 41 of the primary coil 4, as shown in FIG. 8 the individual turns of the second heating portion 41 of the primary coil 4 may be provided with respective taps 46 so that an optional one of the taps 46 is connected to the power source unit 6 (terminal 44). In this configuration, the number of turns of the second heating portion 41 as viewed from the power source unit 6 varies from one tap to another. Therefore, the amount of induction current that is caused to flow through the inner conductor portion 351 of the secondary coil 305 using the single primary coil 4 and the secondary coil 305 can be adjusted by selecting as appropriate a tap to be connected to the power source unit 6.

Figure 9:
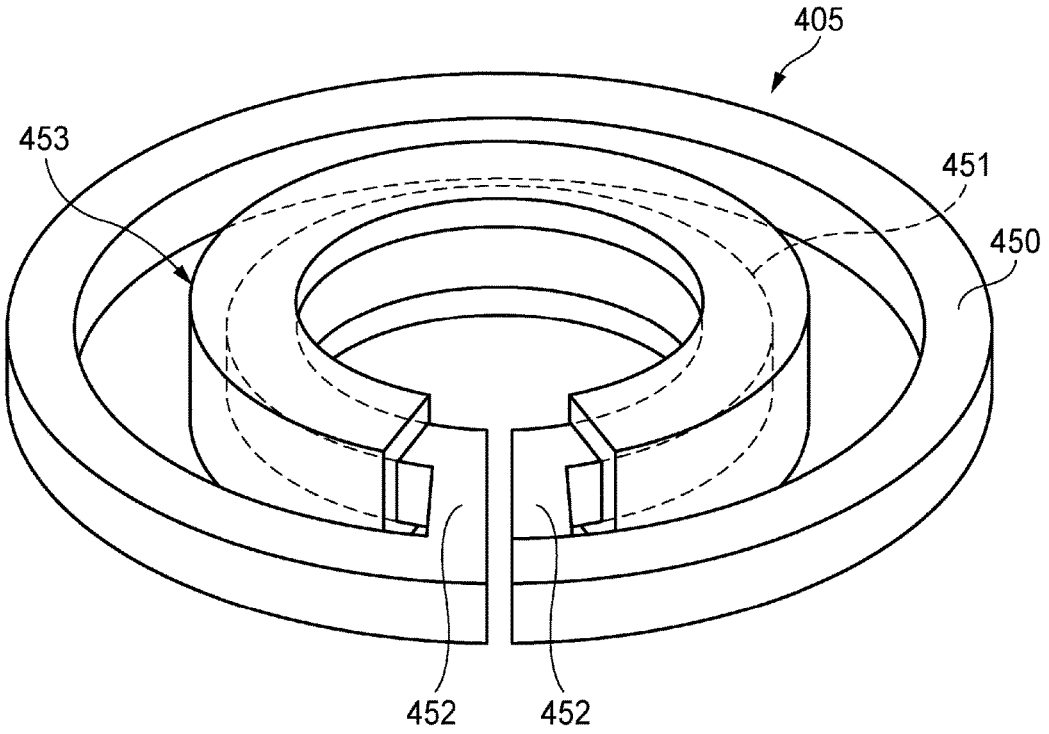
FIG. 9 is a view illustrating a structure of an example of a secondary coil having a core, for describing an embodiment of the invention.

FIG. 9 shows the structure of still another example secondary coil.

Like the secondary coil 205 shown in FIG. 6, the secondary coil 405 shown in FIG. 9 has an outer conductor portion 450 and an inner conductor portion 451, each having a ring shape that is divided at one position in the circumferential direction, and a pair of connection conductor portions 452 connecting the outer conductor portion 450 and the inner conductor portion 451 to each other in series, forming a closed circuit circulating the outer conductor portion 450 and the inner conductor portion 451.

The secondary coil 405 also has a core member 453 for adjusting the expanse of a magnetic flux generated by the secondary coil 405. The core member 453 is interposed between the outer conductor portion 450 and the inner conductor portion 451. By adjusting the expanse of a magnetic flux generated by the secondary coil 405 by means of the core member 453, the magnetic flux generated by the secondary coil 405 can be caused to cross a local portion of the workpiece 2 in a concentrated manner and can increase the heating efficiency there.

Figure 10:
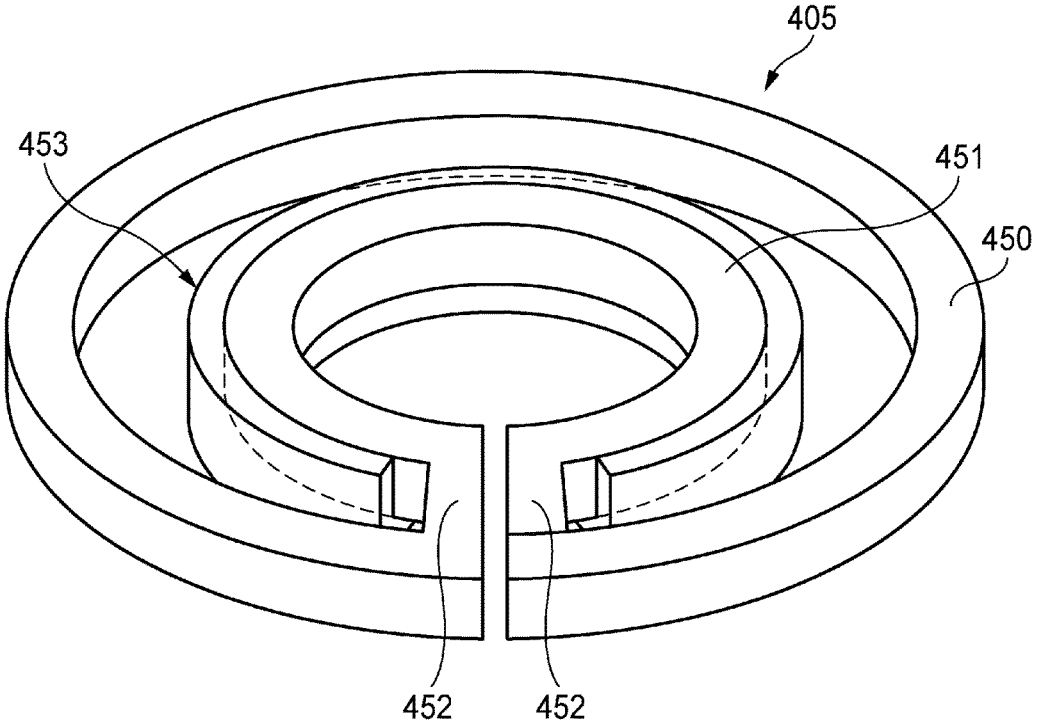
FIG. 10 is a view illustrating a structure of another example of the secondary coil having a core.
Figure 11:
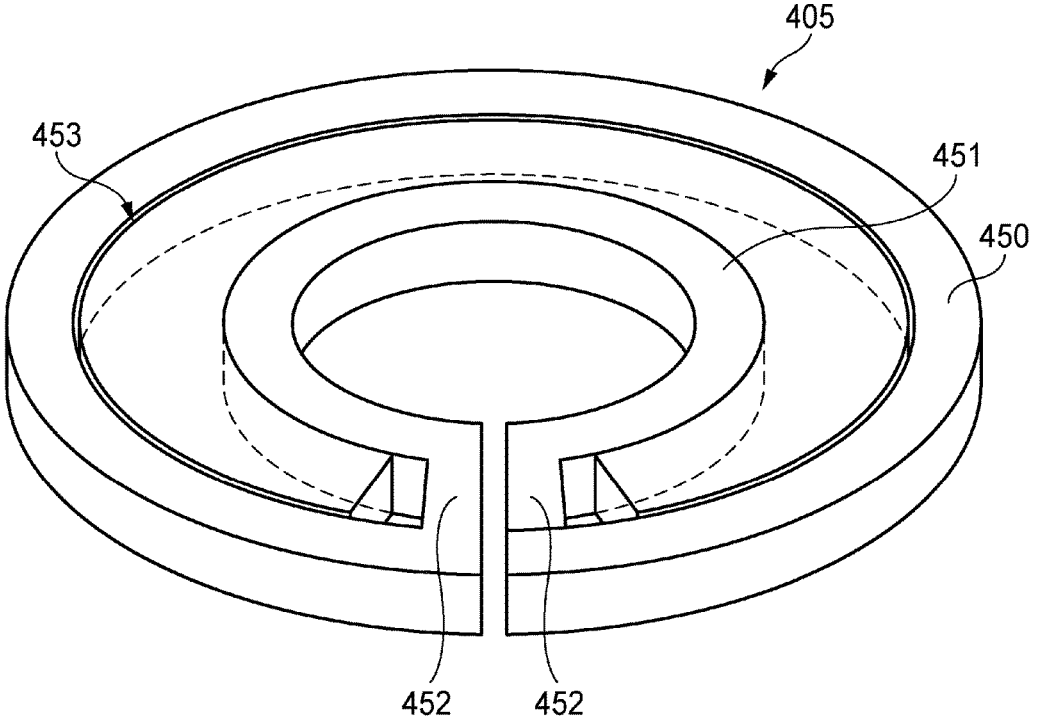
FIG. 11 is a view illustrating a structure of a further example of the secondary coil having a core.

The shape of the core member 453 can be changed in a various manner according to a shape of the workpiece 2 and desired heating temperature distribution of the workpiece 2. In the example of FIG. 9, the core member 453 is configured to cover the surfaces, excluding the inner circumferential surface, of the inner conductor portion 451 approximately over its entire circumference. As shown in FIG. 10, the core member 453 may be configured to cover the surfaces, excluding the inner circumferential surface and one end surface in the axial direction, of the inner conductor portion 451 approximately over its entire circumference. Alternatively, as shown in FIG. 11, the core member 453 may be configured to fill the space between the outer conductor portion 450 and the inner conductor portion 451.

Test Examples will be described below.

Figure 12:
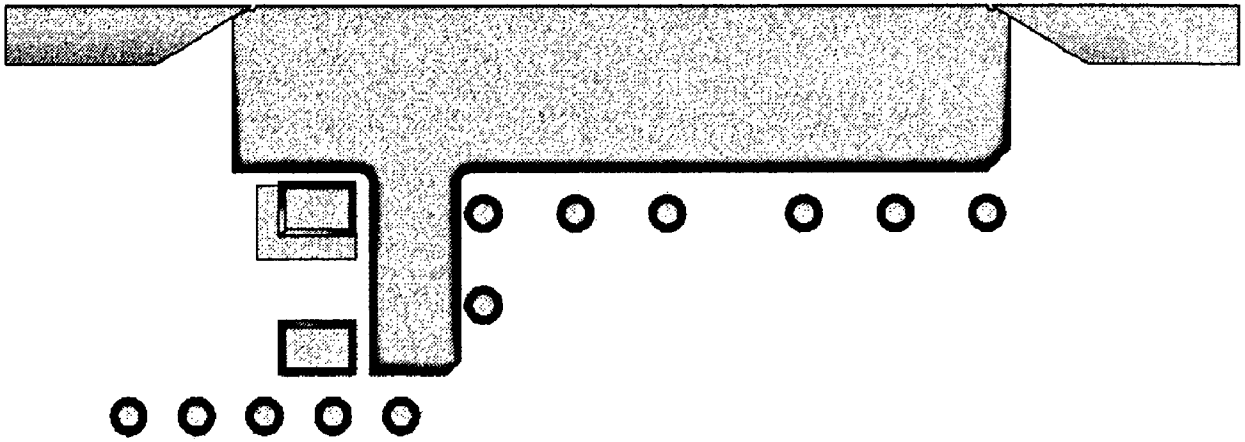
FIG. 12 is a view illustrating a current distribution in a workpiece.

First, in Test Example 1, in induction heating of a double-side-stepped workpiece using an induction heating coil having a primary coil and a secondary coil, a distribution of current flowing through the workpiece was analyzed by a simulation. It was assumed that the workpiece had the same structure as the workpiece 2 shown in FIG. 1 does and that the secondary coil was like the secondary coil 405 shown in FIG. 10 which has the core member. An analysis result is shown in FIG. 12. In FIG. 12, the current density is represented in gray scale such that the gradation level becomes higher as the current density increases.

As shown in FIG. 12, it is seen that although the gap between the shorter, small-diameter shaft portion (22) of the workpiece that is accommodated in the secondary coil and the primary coil is larger than the gaps between the large-diameter shaft portion (20) and the longer, small-diameter shaft portion (21) of the workpiece and the primary coil, the current density in the shorter, small-diameter shaft portion (22) of the workpiece that is accommodated in the secondary coil can be increased so as to be substantially equal to current densities in the large-diameter shaft portion (20) and the longer, small-diameter shaft portion (21) of the workpiece.

Next, Test Examples 2 to 4 will be described in which induction heating heat treatment was performed on a workpiece having the same structure as the workpiece 2 shown in FIG. 1. To heat the surfaces of the workpiece to 950° C., heating conditions were set as follows.

<Heating Conditions>

Supply power: 50 kW

Frequency: 3 kHz

Power supply time: 40 sec

In Test Example 2, a primary coil of an induction heating coil for induction heating the workpiece had the same structure as the primary coil 4 shown in FIG. 1 does and its heating portion to accommodate the large-diameter shaft portion (20) and the shorter, small-diameter shaft portion (22) of the workpiece was of three turns. A secondary coil had the same structure as the secondary coil 405 having the core member 453 does (see FIG. 10).

In Test Example 3, a primary coil had the same structure as the primary coil 4 shown in FIG. 1 and its heating portion to accommodate the large-diameter shaft portion (20) and the shorter, small-diameter shaft portion (22) of the workpiece was of five turns. The specifications of the primary coil and the secondary coil of Test Example 3 were the same as those of Test Example 2 except the number of turns of the heating section of the primary coil.

In Test Example 4, a primary coil had the same structure as the primary coil 4 shown in FIG. 1 and its heating portion to accommodate the large-diameter shaft portion (20) and the shorter, small-diameter shaft portion (22) of the workpiece was of five turns. A secondary coil had the same structure as the secondary coil 305 shown in FIG. 7 does. The specifications of the primary coil and the secondary coil of Test Example 3 were the same as those of Test Example 2 except the number of turns of the heating section of the primary coil and the facts that the secondary coil was not provided with a core member and the axial dimension of the outer conductor portion of the secondary coil was made long.

Surface temperatures of the large-diameter shaft portion (20), longer, small-diameter shaft portion (21), and the shorter, small-diameter shaft portion (22) of the workpiece were measured immediately after execution of heating treatment in each of Examples experiments 2-4. Measurement results are as follows:

| | large-diameter shaft portion | longer, small-diameter shaft portion | shorter, small-diameter shaft portion |
|---|---|---|---|
| Test Example 2 | 920° C. | 950° C. | 900° C. |
| Test Example 3 | 940° C. | 950° C. | 940° C. |
| Test Example 4 | 930° C. | 950° C. | 930° C. |

From the above results, it has been confirmed that the heating efficiency of the shorter, small-diameter shaft portion can be increased by accommodating the shorter, small-diameter shaft portion (22), forming a relatively large gap with the primary coil, of the workpiece and induction heating it via the secondary coil and that the heating efficiency of the shorter, small-diameter shaft portion can be increased further by increasing the number of turns of the heating portion of the primary coil that accommodates the secondary coil. It has also been confirmed that heating efficiency that is equivalent to heating efficiency of a case using a core member can be obtained without a core member by elongating the outer conductor portion of the secondary coil according to increase in the number of turns of the heating portion of the primary coil that accommodates the secondary coil.

INDUSTRIAL APPLICABILITY

The present invention can provide an induction heating coil, an induction heating device, and a heating method that can be suitably used for heat treatment of a double-side-stepped workpiece having a relatively thick portion and relatively thin portions provided on both sides thereof.

While the present invention has been described in detail with reference to certain embodiments thereof, those skilled in the art will understand that various changes and modifications may be made therein without departing from the spirit and scope of the invention. The present application is based on Japanese Patent Application No. 2013-191778 filed on Sep. 17, 2013, the content of which is incorporated herein by reference.

DESCRIPTION OF REFERENCE SIGNS

1: Heating device
2: Workpiece
3: Induction heating coil
4: Primary coil
5: Secondary coil
6: Power source unit
7: Workpiece supporting portion
8: Primary coil supporting portion
9: Secondary coil supporting portion
20: Large-diameter shaft portion
21: Small-diameter shaft portion
22: Small-diameter shaft portion

The invention claimed is:

1. An induction heating coil comprising:
a primary coil to which electric power is supplied; and
a ring-shaped secondary coil forming a closed circuit,
wherein the primary coil comprises a base-side portion that covers an outer periphery of the secondary coil and a distal-side portion extending from the base-side portion in a center axis direction of the secondary coil in a state in which the base-side portion covers the secondary coil, and an opening width of the base-side portion is greater than an opening width of the distal-side portion,
wherein the secondary coil is provided such that the secondary coil is removable inserted into the primary coil from the base-side portion of the primary coil, and
wherein the primary coil and the secondary coil are disposed such that at least part of a workpiece is accommodated between the distal-side portion of the primary coil and the secondary coil.

2. The induction heating coil according to claim 1, wherein the secondary coil comprises a ring-shaped outer conductor portion and a ring-shaped inner conductor portion provided inside the outer conductor portion with a space being provided between the inner conductor portion and the outer conductor portion, and wherein the outer conductor portion and the inner conductor portion are connected to each other in series to form a closed circuit.

3. The induction heating coil according to claim 2, wherein the inner conductor portion is connected to the outer conductor portion such that current flows through the inner conductor portion in a direction opposite to a direction in which the current flows through the outer conductor portion.

4. The induction heating coil according to claim 2, wherein the secondary coil comprises at least one core member interposed between the outer conductor portion and the inner conductor portion.

5. The induction heating coil according to claim 1, wherein the primary coil has a cylindrical shape.

6. The induction heating coil according to claim 5, wherein the primary coil is a solenoid coil.

7. An induction heating device comprising:
the induction heating coil according to claim 1;
a power source unit configured to supply the electric power to the primary coil of the induction heating coil;
a workpiece supporting portion configured to support the workpiece and to move the workpiece relative to the primary coil to insert the workpiece into the primary coil from the base-side portion of the primary coil; and
a secondary coil supporting portion configured to support the secondary coil of the induction heating coil and to move the secondary coil relative to the primary coil to insert the secondary coil into the primary coil from the base-side portion of the primary coil.

8. A heating method for heating a workpiece having a relatively thick portion and relatively thin portions provided on both sides of the thick portion using an induction heating coil, the heating method comprising:
inserting the workpiece into a primary coil of the induction heating coil from a base-side portion of the primary coil that is adapted to cover an outer periphery of a ring-shaped secondary coil such that one of the thin portions of the workpiece is accommodated in a distal-side portion of the primary coil that extends from the base-side portion in a center axis direction of the secondary coil in a state in which the base-side portion covers the secondary coil, and such that the thick portion and the other thin portion of the workpiece are accommodated in the base-side portion of the primary coil;
inserting the secondary coil of the induction heating coil into the primary coil from the base-side portion of the primary coil such that the secondary coil is arranged between the base-side portion of the primary coil and the thin portion of the workpiece that is accommodated in the base-side portion such that the base-side portion of the primary coil covers the secondary coil; and
supplying the electric power to the primary coil to inductively heat the workpiece,
wherein the primary coil and the secondary coil are disposed such that at least part of the workpiece is accommodated between the distal-side portion of the primary coil and the secondary coil.

9. A secondary coil to be accommodated in a primary coil to which electric power is supplied, the secondary coil comprising:
a ring-shaped outer conductor portion; and
a ring-shaped inner conductor portion provided inside the outer conductor portion with a space located between the inner conductor portion and the outer conductor portion; and
at least one core member interposed in the space between the outer conductor portion and the inner conductor portion,
wherein the primary coil and the secondary coil are disposed such that at least part of a workpiece is accommodated between a distal-side portion of the primary coil and the secondary coil.

10. The induction heating coil according to claim 1, wherein
the secondary coil comprises a ring-shaped outer conductor portion, a ring-shaped inner conductor portion provided inside the outer conductor portion with a space located between the inner conductor portion and the outer conductor portion, and at least one core member interposed in the space between the outer conductor portion and the inner conductor portion,
the ring-shaped outer conductor portion has four surfaces,
the ring-shaped inner conductor portion has four surfaces, a first surface of the four surfaces of the ring-shaped outer conductor portion faces a first surface of the four surfaces the ring-shaped inner conductor portion, and the at least one core member is interposed between the first surface of the outer conductor portion and the first surface of the inner conductor portion.

11. The induction heating coil according to claim 10, wherein the at least one core member covers the first surface of the inner conductor portion and a second surface of the four surfaces of the inner conductor portion that is adjacent to the first surface.

12. The induction heating coil according to claim 10, wherein the at least one core member covers the first surface of the inner conductor portion, a second surface of the four surfaces of the inner conductor portion that is adjacent to the first surface, and a third surface of the four surfaces of the inner conductor portion that is adjacent to the first surface.

13. The heating method according to claim 8, wherein the secondary coil comprises a ring-shaped outer conductor portion, a ring-shaped inner conductor portion provided inside the outer conductor portion with a space located between the inner conductor portion and the outer conductor portion, and at least one core member interposed in the space between the outer conductor portion and the inner conductor portion, the ring-shaped outer conductor portion has four surfaces, the ring-shaped inner conductor portion has four surfaces, a first surface of the four surfaces of the ring-shaped outer conductor portion faces a first surface of the four surfaces the ring-shaped inner conductor portion, and the at least one core member is interposed between the first surface of the outer conductor portion and the first surface of the inner conductor portion.

14. The heating method according to claim 13, wherein the at least one core member covers the first surface of the inner conductor portion and a second surface of the four surfaces of the inner conductor portion that is adjacent to the first surface.

15. The heating method according to claim 13, wherein the at least one core member covers the first surface of the inner conductor portion, a second surface of the four surfaces of the inner conductor portion that is adjacent to the first surface, and a third surface of the four surfaces of the inner conductor portion that is adjacent to the first surface.

16. The secondary coil according to claim 9, wherein the ring-shaped outer conductor portion has four surfaces, the ring-shaped inner conductor portion has four surfaces, a first surface of the four surfaces of the ring-shaped outer conductor portion faces a first surface of the four surfaces the ring-shaped inner conductor portion, and the at least one core member is interposed between the first surface of the outer conductor portion and the first surface of the inner conductor portion.

17. The secondary coil according to claim 16, wherein the at least one core member covers the first surface of the inner conductor portion and a second surface of the four surfaces of the inner conductor portion that is adjacent to the first surface.

18. The secondary coil according to claim 16, wherein the at least one core member covers the first surface of the inner conductor portion, a second surface of the four surfaces of the inner conductor portion that is adjacent to the first surface, and a third surface of the four surfaces of the inner conductor portion that is adjacent to the first surface.

19. The induction heating coil according to claim 1, wherein a width of the relatively thick portion of the workpiece is greater than the opening width of the distal-side portion of the primary coil and smaller than the opening width of the base-side portion of the primary coil.

* * * * *